US011774189B2

(12) United States Patent
Xu et al.

(10) Patent No.: US 11,774,189 B2
(45) Date of Patent: Oct. 3, 2023

(54) HEAT EXCHANGER, HARDWAY FIN ARRANGEMENT FOR A HEAT EXCHANGER, AND METHODS RELATING TO SAME

(71) Applicant: Air Products and Chemicals, Inc., Allentown, PA (US)

(72) Inventors: Fang Xu, Orefield, PA (US); Declan Patrick O'Connor, Chessington (GB); William T Kleinberg, Emmaus, PA (US); Patrick A. Houghton, Emmaus, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 349 days.

(21) Appl. No.: 17/036,167

(22) Filed: Sep. 29, 2020

(65) Prior Publication Data

US 2022/0099385 A1 Mar. 31, 2022

(51) Int. Cl.
*F28F 3/12* (2006.01)
*F28F 3/02* (2006.01)

(52) U.S. Cl.
CPC ..... *F28F 3/027* (2013.01); *F28F 2215/08* (2013.01)

(58) Field of Classification Search
CPC ..... F28F 3/027; F28F 2215/08
USPC ..... 165/168
See application file for complete search history.

(56) References Cited

U.S. PATENT DOCUMENTS 4,699,209 A 10/1987 Thorogood
5,122,174 A 6/1992 Sunder et al.
5,709,264 A * 1/1998 Sweeney ..... B01D 3/008 165/146
5,718,127 A * 2/1998 Aitken ..... F28F 25/087 196/100
5,722,258 A * 3/1998 Aitken ..... F25J 5/007 196/100
5,724,834 A * 3/1998 Srinivasan ..... F25J 5/005 62/643
5,730,209 A * 3/1998 Sunder ..... F25J 3/04824 165/95
5,901,574 A * 5/1999 Rohde ..... F25J 5/005 62/903

(Continued)

OTHER PUBLICATIONS

Chakravarthy V. S. etal; "Developments in Falling Film Type (Downflow) Reboilers in the Air Separation Industry", Proceedings of 5th International Conference of Enhanced, Compact & Ultra-Compact Heat Exchangers: Science, Engineering and Technology, vol. P6, Sep. 1, 2005 pp. 264-272.

*Primary Examiner* — Claire E Rojohn, III
(74) *Attorney, Agent, or Firm* — Matthew R. Weaver

(57) ABSTRACT

A heat exchanger can be configured to utilize multiple sections of hardway fins that can be configured so that an upper first section of the fins can build up liquid head and a second lower section of the fins can be configured to distribute liquid in an even, or uniform, manner. The first section of fins can utilize a different type of hole arrangement than the second section of fins. For instance, the diameter or width of the holes in the first section may differ from the diameter or width of the holes of the second section. In addition (or as an alternative), fin frequency and/or spacing between immediately adjacent holes in the first section of fins may be different from the spacing between immediately adjacent holes in the second section of fins.

18 Claims, 6 Drawing Sheets

(56) References Cited

U.S. PATENT DOCUMENTS

| | | | | |
|---|---|---|---|---|
| 6,189,338 | B1 * | 2/2001 | Lehman | B01D 5/0015 62/643 |
| 6,338,384 | B1 * | 1/2002 | Sakaue | F28D 9/0068 62/903 |
| 6,360,561 | B2 | 3/2002 | Allam et al. | |
| 7,163,051 | B2 * | 1/2007 | Jibb | F28F 9/026 165/110 |
| 8,298,412 | B2 * | 10/2012 | Nieuwoudt | B01J 19/325 261/95 |
| 10,118,148 | B2 * | 11/2018 | Sakakura | F28D 9/0093 |

* cited by examiner

HEAT EXCHANGER, HARDWAY FIN ARRANGEMENT FOR A HEAT EXCHANGER, AND METHODS RELATING TO SAME

FIELD OF THE INVENTION

The present innovation relates to heat exchangers, hardway fin arrangements for heat exchangers, plants having at least one heat exchanger and methods of making and using the same.

BACKGROUND OF THE INVENTION

Heat exchangers are often used in different types of plants. For instance, air separation plants often include one or more heat exchangers. Examples of heat exchangers can be appreciated from U.S. Pat. Nos. 4,699,209, 5,122,174, 5,730,209, and 6,360,561. Some types of heat exchangers can be considered to be a downflow heat exchanger, such as a downflow reboiler. U.S. Pat. No. 5,122,174 discloses an example of this type of heat exchanger.

In some types of downflow heat exchangers, both the warm stream and the cold stream flow from the top of the heat exchanger to the bottom of the heat exchanger. The cold stream can be an oxygen (O2) stream. Liquid O2 can be fed from the top and can boil inside of the heat exchanger. The warm stream can be a nitrogen (N2) stream. The N2 vapor can be fed from the top and can condense inside of the heat exchanger as heat is transferred from the N2 to the O2. The liquid O2 can be fed from a liquid tank which is above the heat exchanger. To ensure even flow distribution of liquid oxygen in the heat exchanger, a minimum liquid level in the liquid tank is required.

As can be seen from U.S. Pat. No. 5,730,209, hardway fins are often utilized to provide sufficient flow resistance. These hardway fins are often installed between the liquid tank and the heat transfer fins of the heat exchanger. The hardway fins are orientated so that the flow direction is normal to the low flow resistance channels. In contrast, easyway fins of the heat exchanger that are located downstream of the hardway fins are orientated so that the flow direction is parallel to the low flow resistance channels.

As a part of the maintenance of a plant, a downflow heat exchanger is often required to be defrosted as explained in U.S. Pat. No. 5,730,209. During a defrost operation, defrost gas can be injected into the heat exchanger in between two sections of hardway fin. Conventionally, the hardway fin sections have the same fin geometry in terms of the distance between holes in the heat exchanger width direction, the distance between holes in the fin height (or length) direction, the hole diameter or width, and the fin frequency (number of fins per unit length, e.g. fins per inch or fins per centimeter (cm)).

SUMMARY

We have determined that when a plant is operated under a turndown condition, less liquid is produced to pass to a downflow heat exchanger. We have determined that at low enough turndown, problems in the heat exchanger operation can result. For example, when the hardway fin change in pressure falls below a 100% flooded condition, it can become more likely that vapor generated in the heat transfer fins (also referred to as easyway fins) will enter the hardway fins. This can lead to a liquid head along the heat exchanger width direction that is non-uniform, which in turn can cause non-even flow distribution of the liquid in the heat transfer fins. Such maldistribution can be detrimental to heat exchanger operational efficiency. For example, for heat exchangers in liquid oxygen (LOX) service, this type of counter-current flow of vapor can lead to a concentration of hydrocarbon impurities becoming present in the heat exchanger, which can be a safety concern if the local LOX hydrocarbon concentration becomes too high.

As another example, the decreased amount of liquid that is passed to the heat exchanger at turndown can require the resistance in hardway fins to be increased to maintain the minimum liquid level in the liquid tank so that the passage-by-passage distribution remains uniform. For heat exchangers with low turndown requirements, we determined that this increase in hardway fin resistance can lead to very tall head tanks to accommodate the liquid level under the design operating conditions.

We have determined that increasing the hardway fin resistance can be achieved in several ways. For example, an increase in the distance between holes in the width direction (i.e. hole pitch) can be provided. However, we determined that when the hole pitch is too big in the bottom section of hardway fins, the liquid may not be evenly distributed on the downstream heat transfer fins, which can be detrimental to the operation of the heat exchanger.

We also determined that resistance can also (or alternatively) be increased by reducing the hole diameter. However, a minimum hole diameter is typically required to avoid blockage in brazing of the fins.

We also determined that resistance can also (or alternatively) be increased by increasing the fin frequency (fins per inch, fpi, or fins per cm, etc.). The fin frequency can define a fin density for the hardway fins. In some embodiments, the fin frequency can often range from a first lower threshold value to a second higher threshold value (e.g. 8 fins per inch to 20 fins per inch, 3 fins per inch to 25 fins per inch, 10 fins per inch to 15 fins per inch, 2 fins per cm to 8 fins per cm, 3 fins per cm to 20 fins per cm, etc.). The increased fin frequency can make it easier to achieve 100% hardway fin flooding at the minimum operating condition. For example, increasing the fin frequency for the hardway fins can increase the pressure drop for the same hardway fin length so that less pressure drop can be needed to achieve a 100% flooded hardway fin. However, there can be a maximum fin frequency that can be set by the tooling used to form the fins.

We therefore determined that to address the turndown operational condition issues that affect some types of downflow heat exchangers, a change that simply increases the pitch for holes or makes hole diameter sizing changes or maximized the fin frequency is not always able to provide a fully desired, relatively problem-free solution when there is a high turndown requirement. Instead, we have found that to maintain a minimum liquid level in the liquid tank, the minimum liquid submergence, and even liquid distribution, the fin geometry of the top section of hardway fins can be designed to be different from the fin geometry of the bottom section of hardway fins. This type of change can add flexibility in the downflow heat exchanger design by allowing the heat exchanger to be designed for an increased turndown operation condition by providing an upper section of hardway fins that can provide increased resistance for helping to maintain a minimum liquid level in the tank during a turndown operation of a plant while having a lower section of hardway fins configured to provide increased resistance for helping to maintain a minimum liquid level in the tank and provide a relatively even, or uniform flow distribution of the liquid to downstream heat exchanger fins (e.g. easyway fins).

In embodiments of our heat exchanger and hardway fin arrangement for a heat exchanger, there can be at least two sections of hardway fins. A first section of the hardway fins includes first hardway fins that are configured to provide the backpressure to build up sufficient fluid level of a first fluid in a tank (e.g. a liquid level in a liquid tank in which an oxygen rich liquid may be retained for feeding to the heat exchanger to be heated). A second lower section of hardway fins can include second hardway fins that can be provided downstream of the first section of hardway fins (e.g. below the first section of hardway fins for a downflow heat exchanger in which the flow of a first fluid passes from an upper portion of the heat exchanger to a lower portion of the heat exchanger) that are configured to provide the backpressure to build up sufficient fluid level of a first fluid in a tank and for distributing the fluid evenly (or more evenly) on downstream heat transfer fins (e.g. distributing liquid, such as an oxygen rich liquid for example for uniform or substantially uniform distribution on downstream easywayfins).

For example, in some embodiments, a heat exchanger can include a body connected to a tank configured to retain a first fluid. A first section of first hardway fins can be positioned in the body adjacent to a position at which the first fluid is fed into the body for passing toward the first hardway fins. A second section of second hardway fins can be positioned in the body such that that first hardway fins are positioned between the second hardway fins and the position at which the first fluid is fed into the body. The first hardway fins can be configured to provide a backpressure for maintenance of a fluid level of the first fluid in the tank at or above a minimum fluid level. The second hardway fins can be configured to provide a backpressure for maintenance of the fluid level of the first fluid in the tank at or above the minimum fluid level and facilitate fluid distribution for distributing the first fluid on easyway fins. The easyway fins can be positioned in the body of the heat exchanger such that the second hardway fins are located between the first hardway fins and the easyway fins. The first section of the first hardway fins and the second section of the second hardway fins can be positioned and configured so that a first flow resistance per unit length of the body for the first section of the first hardway fins differs from a second flow resistance per unit length of the body for the second hardway fins.

In some embodiments, each the first hardway fins can be configured to provide a backpressure for maintenance of the fluid level in the tank by having holes in a body of the first hardway fin. The holes can have a first hole pitch and a second hole pitch that define spacing between immediately adjacent holes and each of the holes can have a hole diameter. Each the second hardway fins can be configured to provide a backpressure for maintenance of the fluid level in the tank and facilitate fluid distribution for distributing the first fluid on easyway fins having holes in a body of the second hardway fin. The holes of the second hardway fins can have a first hole pitch and a second hole pitch that define spacing between immediately adjacent holes and each of the holes of the second hardway fins can have a hole diameter. The first section of first hardway fins can also be arranged and structured to have a first fin frequency and the second section of second hardway fins can be arranged and structured to have a second fin frequency. In some embodiments, the first and second hardway fins can be arranged, sized and configured so that one or more of the following parameters exist: (i) the first hole pitch of the holes of the first hardway fins differ from the first hole pitch of the holes of the second hardway fins, (ii) the second hole pitch of the holes of the first hardway fins differ from the second hole pitch of the holes of the second hardway fins, (iii) the hole diameter of the holes of the first hardway fins differs from the hole diameter of the of the holes of the second hardway fins, and (iv) the first fin frequency for the first section of the first hardway fins differs from the second fin frequency for the second section of the second hardway fins. Some embodiments may utilize all of the parameters (i)-(iv) while others may utilize a sub-set of these parameters (e.g. only a single one of these parameters or a combination of two of these parameters or a combination of three of these parameters, etc.).

The first hole pitch of the first hardway fins can be a distance about which immediately adjacent holes are spaced apart in a width direction so that immediately adjacent holes in a row of holes are each spaced apart by a first distance for the first hardway fins. The first hole pitch of the second hardway fins can be a second distance about which immediately adjacent holes are spaced apart in a width direction so that immediately adjacent holes in a row of holes are each spaced apart by a second distance for the second hardway fins. In some embodiments, the first distance can be a maximum of 50 mm and the second distance can be a maximum of 10 mm.

The second hole pitch of the first hardway fins can be a distance about which immediately adjacent holes are spaced apart in a length direction so that immediately adjacent holes in a column of holes are each spaced apart by a first distance for the first hardway fins. The second hole pitch of the second hardway fins can be a distance about which immediately adjacent holes are spaced apart in a length direction so that immediately adjacent holes in a column of holes are each spaced apart by a second distance for the second hardway fins. In some embodiments, the first distance can be 0.1-0.95 of a fin height of the first hardway fins and the second distance can be 0.1-0.95 of a fin height of the second hardway fins.

In some embodiments, the first hole pitch of the holes of the first hardway fins is a maximum of 50 mm and the first hole pitch of the second hardway fins is a maximum of 10 mm. In some embodiments, the second hole pitch of the holes of the first hardway fins can be 0.1-0.95 of a fin height of the first hardway fins and the second hole pitch of the second hardway fins can be 0.1-0.95 of a fin height of the second hardway fins. In some embodiments, the hole diameter of the first hardway fins can be 1-7 mm and the hole diameter of the second hardway fins can be 1-7 mm.

Embodiments of a hardway fin arrangement for a heat exchanger are also provided. Embodiments of the hardway fin arrangement can include a first section of first hardway fins positionable in a body of a heat exchanger adjacent to a position at which a first fluid from a tank is fed into the body. A second section of second hardway fins can be positionable in the body such that that first hardway fins are locatable between the second hardway fins and the position at which the first fluid from the tank is fed into the body. The first hardway fins can be configured to provide a backpressure for maintenance of a fluid level of the first fluid in the tank. The second hardway fins can be configured to provide a backpressure for maintenance of the fluid level of the first fluid in the tank and facilitate fluid distribution for distributing the first fluid on easyway fins locatable in the body of the heat exchanger such that the second hardway fins are located between the first hardway fins and the easyway fins. The first section of the first hardway fins and the second section of the second hardway fins can be positioned and configured so that a first flow resistance per unit length of the body for the first section of the first hardway fins differs from a second flow resistance per unit length of the body for the second section of the second hardway fins.

Each the first hardway fins can be configured to provide a backpressure for maintenance of the fluid level in the tank by having holes in a body of the first hardway fin where the holes of the first hardway fins have a first hole pitch and a second hole pitch that define spacing between immediately adjacent holes of the first hardway fins and each of the holes of the first hardway fins have a hole diameter. Each the second hardway fins can be configured to provide a backpressure for maintenance of a fluid level of the first fluid in the tank and facilitate fluid distribution for distributing the first fluid on easyway fins by having holes in a body of the second hardway fin. The holes of the second hardway fins can have a first hole pitch and a second hole pitch that define spacing between immediately adjacent holes of the second hardway fins and each of the holes of the second hardway fins can have a hole diameter. The first section of first hardway fins can have a first fin frequency and the second section of second hardway fins can have a second fin frequency.

The first hole pitch of the first hardway fins can be a distance about which immediately adjacent holes are spaced apart in a width direction so that immediately adjacent holes in a row of holes are each spaced apart by a first distance for the first hardway fins. The first hole pitch of the second hardway fins can be a distance about which immediately adjacent holes are spaced apart in a width direction so that immediately adjacent holes in a row of holes are each spaced apart by a second distance for the second hardway fins. The second hole pitch of the first hardway fins can be a distance about which immediately adjacent holes are spaced apart in a length direction so that immediately adjacent holes in a column of holes are each spaced apart by a third distance for the first hardway fins. The second hole pitch of the second hardway fins can be a distance about which immediately adjacent holes are spaced apart in a length direction so that immediately adjacent holes in a column of holes are each spaced apart by a fourth distance for the second hardway fins. The first and second distances may differ from each other and the third and fourth distances may be the same distance in some embodiments. In other embodiments, the third and fourth distances may differ from each other and the first and second distances may also differ from each other. In yet other embodiments, the first, second, third and fourth distances may all be the same distance. For example, the first hole pitch of the holes of the first hardway fins can differ from the first hole pitch of the holes of the second hardway fins and/or the second hole pitch of the holes of the first hardway fins can differ from the second hole pitch of the holes of the second hardway fins. In yet other embodiments, the hole diameter of the holes of the first hardway fins can differ from the hole diameter of the holes of the second hardway fins. The first fin frequency can also differ from the second fin frequency.

A method of providing a hardway fin arrangement for a heat exchanger is also provided. In some embodiments, the method can include folding at least one first sheet of material to form first hardway fins for a first section of hardway fins. The first sheet of material can have holes. The holes can have a first hole pitch and a second hole pitch that define spacing between immediately adjacent holes of the first sheet of material. Each of the holes of the first sheet of material can also having a hole diameter. The method can also include folding at least one second sheet of material to form second hardway fins for a second section of hardway fins. The second sheet of material can have holes. These holes can have a first hole pitch and a second hole pitch that define spacing between immediately adjacent holes of the second sheet of material and each of the holes of the second sheet of material can also have a hole diameter. The folding of the at least one first sheet of material and the folding of the at least one second sheet of material can be performed so that the first section of the first hardway fins and the second section of the second hardway fins are formed so that a first flow resistance per unit length of the body of the heat exchanger for the first section of the first hardway fins differs from a second flow resistance per unit length of the body of the heat exchanger for the second hardway fins. In some embodiments, these different flow resistances per unit length can be provided via one or more of:

(i) the first hole pitch of the holes of the first sheet of material differing from the first hole pitch of the holes of the second sheet of material (ii) the second hole pitch of the holes of the first sheet of material differing from the second hole pitch of the holes of the second sheet of material;

(iii) the hole diameter of the holes of the first sheet of material differing from the hole diameter of the holes of the second sheet of material; and/

(iv) a first fin frequency of the first section of the first hardway fins differing from a second fin frequency of the second section of the second hardway fins.

In some embodiments all of the conditions (i)-(iv) may be present. In yet other embodiments only one or only two of these conditions may be present or only three of these conditions may be present.

Embodiments of the method can also include other steps. For instance, the first and second sections of the first and second hardway fins can be positioned and/or installed in the body of the heat exchanger.

Other details, objects, and advantages of the manifolds for heat exchangers, heat exchangers, plants having a heat exchanger apparatus that includes manifolds and a plurality of heat exchangers, and methods of making and using the same will become apparent as the following description of certain exemplary embodiments thereof proceeds.

BRIEF DESCRIPTION OF THE DRAWINGS

Exemplary embodiments of heat exchangers, hardway fin arrangements for heat exchangers, plants having at least one heat exchanger, and methods of making and using the same are shown in the drawings included herewith. It should be understood that like reference characters used in the drawings may identify like components.

Figure 5:
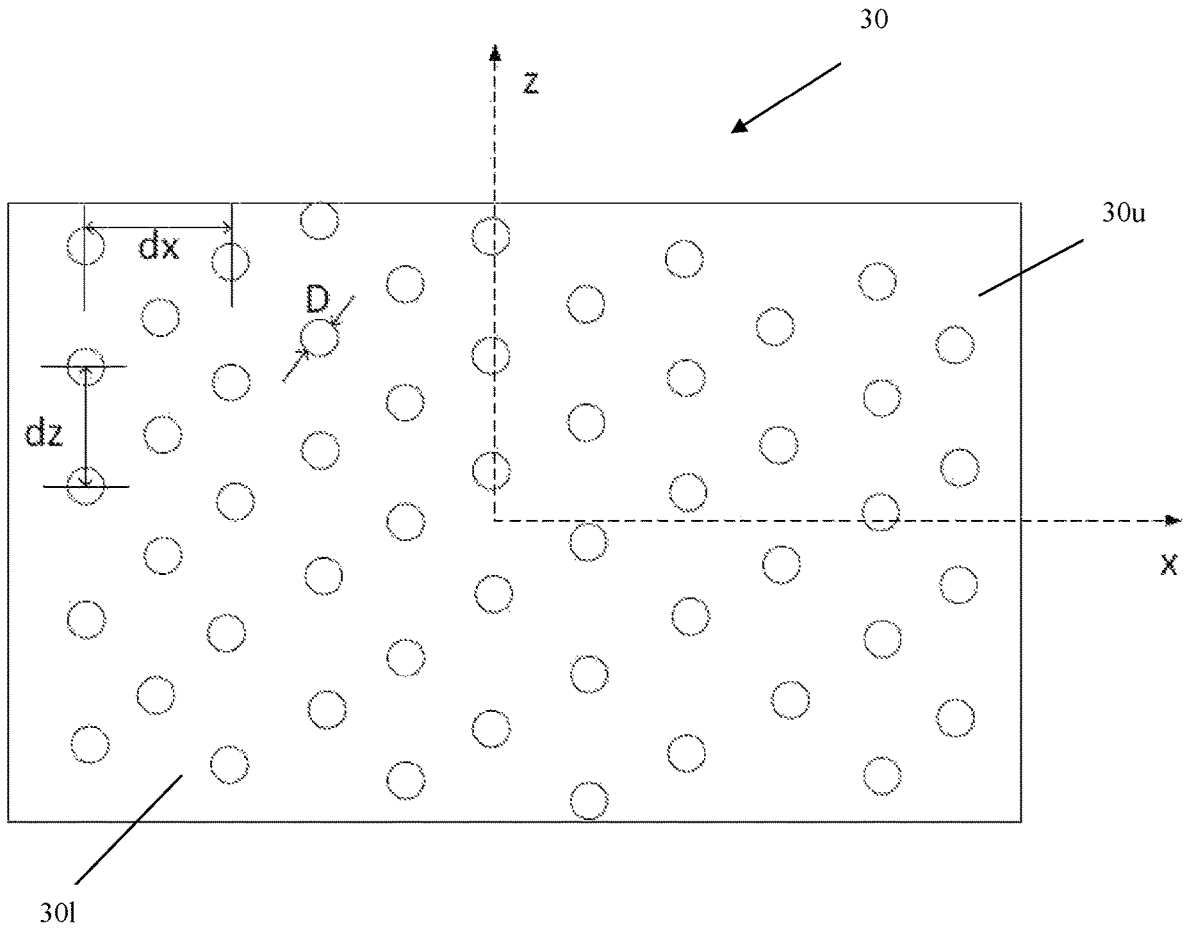
FIG. 5 is a schematic view of an exemplary hole arrangement for an exemplary section of hardway fins of the first exemplary embodiment of the heat exchanger (e.g. the first section of hardway fins of the first exemplary embodiment of the heat exchanger or the second section of hardway fins of the first exemplary embodiment of the heat exchanger).
Figure 6:
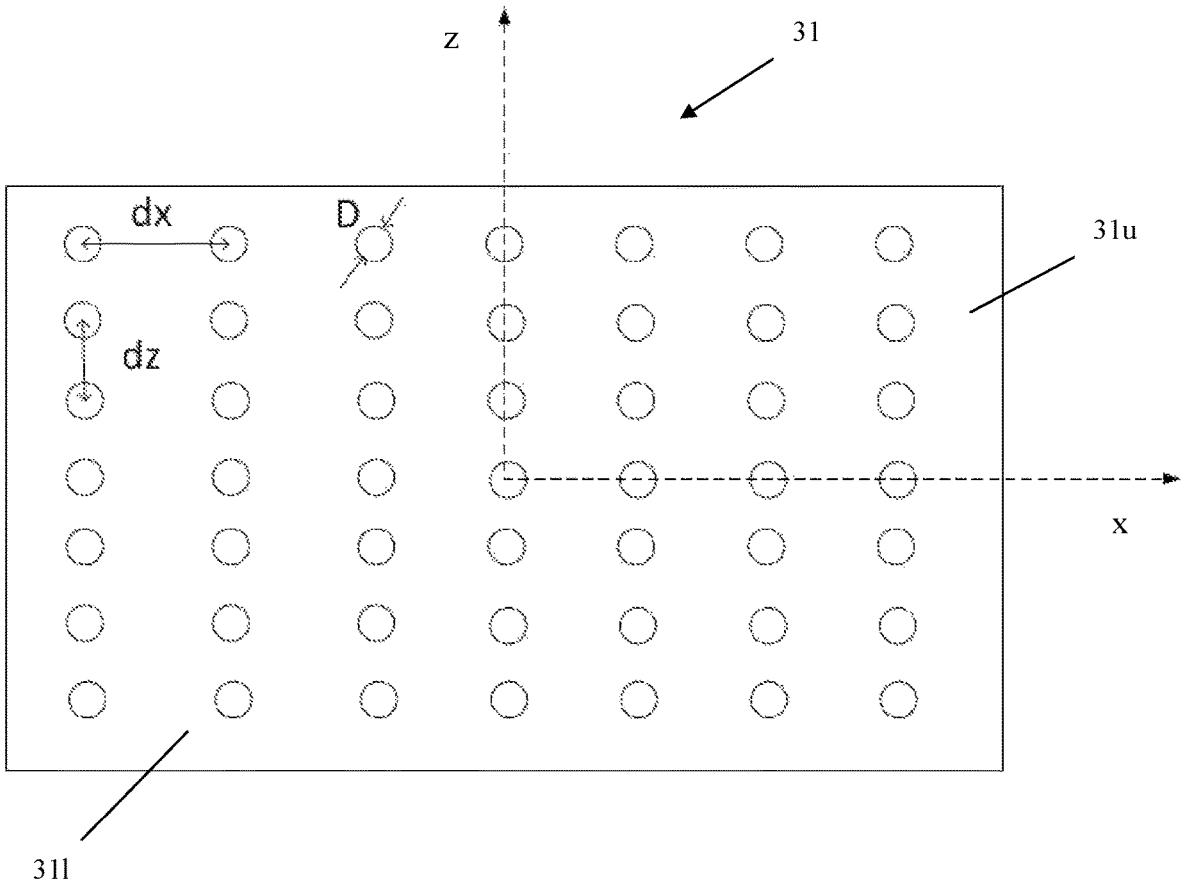
FIG. 6 is a schematic view of an exemplary hole arrangement for another exemplary section of hardway fins of the first exemplary embodiment of the heat exchanger that differs from the arrangement of FIG. 5 (e.g. the first section of hardway fins for an embodiment where the arrangement of FIG. 5 is utilized in the second section of hardway fins or the second section of hardway fins for an embodiment in which the arrangement of FIG. 5 is utilized in the first section of hardway fins).

It should be appreciated that the exemplary embodiments of hardway fin arrangements of FIGS. 5 and 6 are examples. Other embodiments may utilize other types of differing hole arrangements for different sections of hardway fins.

DETAILED DESCRIPTION

Referring to FIGS. 1-6, a plant 1 can be configured as an air separation plant or other type of plant. The plant 1 can include a heat exchanger 3. In some embodiments, the heat exchanger 3 can be configured as a downflow heat exchanger. For instance, the heat exchanger 3 can be configured and arranged as the main condenser/reboiler of a double column cryogenic air separation plant in some embodiments.

In some embodiments, the heat exchanger 3 can be configured for concurrent condensation of a nitrogen rich vapor and vaporization of an oxygen rich liquid in a distillation column based air separation unit plant. For example, the heat exchanger 3 can be configured as a condenser-reboiler heat exchanger located between a lower pressure column and a higher pressure column and be configured to condense a nitrogen rich vapor from the higher pressure column and partially vaporize an oxygen rich liquid from the lower pressure column.

For example, the plant 1 can include an arrangement that includes a compressor for compressing feed air. The compressed air can then be purified and cooled to a temperature suitable for its rectification. The purified and cooled air can then be introduced into a higher pressure distillation column where an ascending vapor phase is contacted with a descending liquid phase by mass transfer contacting elements (e.g. structured packing, random packing or sieve trays or a combination of such packing and trays, etc.). The ascending vapor phase of the air can become rich in nitrogen (N2) as it ascends and a descending liquid phase can become rich in oxygen (O2). As a result, a bottoms liquid, which can be referred to as crude liquid oxygen or kettle liquid, can be collected at the bottom of at least one distillation column of the plant and a nitrogen rich vapor can be collected at the top or upper portion of at least one distillation column of the plant.

A feed stream of the nitrogen rich vapor can be introduced into a nitrogen rich vapor inlet conduit 2 that is coupled to the heat exchanger 3. The nitrogen rich vapor inlet conduit 2 can feed the nitrogen rich vapor at a location near the bottom of the heat exchanger 3 or near the top or side of the heat exchanger 3 for being fed into the heat exchanger 3 and released within the shell of the heat exchanger. The nitrogen rich vapor can be fed so that this vapor flows in co-current flow or counter current flow with oxygen rich liquid that can be fed to and passed through the heat exchanger 3. In some counter current flow arrangements, the nitrogen rich vapor can be fed near the top or at the top of the heat exchanger and the oxygen rich liquid can be fed to the bottom or near the bottom of the heat exchanger.

The oxygen rich liquid can be transported from one or more distillation column bottoms of the plant 1 to an upper portion of the heat exchanger 3 or to a lower portion of the heat exchanger 3 via an oxygen inlet conduit 4. The liquid oxygen can be collected in a reservoir of the heat exchanger 3 or a tank connected to the heat exchanger 3. The heat exchanger 3 can be configured so that the liquid oxygen flow is fed from the reservoir to descend within the heat exchanger 3 in a downflow type heat exchanger arrangement via one or more distributors, such as sprayers or nozzles positioned in the body of the heat exchanger.

Heat from the nitrogen rich vapor can be transferred to the cooler liquid oxygen during operation of the heat exchanger 3. The heating of the oxygen rich flow can result in vaporization of the oxygen rich liquid to produce a two phase oxygen rich effluent stream that exits proximate the bottom of the heat exchanger 3 via a first oxygen output conduit 7. The first oxygen output conduit 7 can be configured to transport the heated oxygen rich stream for extraction of the oxygen to form an oxygen product. The output oxygen stream from the first oxygen output conduit 7 can also be processed so that a portion of the oxygen is processed to form an oxygen product and another portion is fed to a plant unit (e.g. the low pressure distillation column or other unit). For instance, a portion of the oxygen can be routed to be part of a stream of another distillation column or recycled back to a low pressure column. Any oxygen liquid that is not vaporized in the heat exchanger 3 can be fed via another oxygen outlet conduit (not shown) to be routed to another process unit as well for use of the non-vaporized liquid oxygen.

The nitrogen flow of fluid passed through the heat exchanger 3 can be output from the heat exchanger to be fed to another plant process via a nitrogen output conduit 9. The nitrogen rich fluid transported via the nitrogen output conduit 9 can be processed to form a nitrogen gas product and/or be fed to one or more the columns of the plant for further use (e.g. a portion of the nitrogen gas can be used to form a nitrogen gas product while another portion is recycled to a column or used in another plant process).

The heat exchanger 3 can be configured so that it can undergo maintenance operations as part of the maintenance of the plant 1. For instance, the heat exchanger 3 may undergo defrosting operations at different times as part of plant maintenance. Defrost gas can be fed to the heat exchanger via a defrost gas conduit 5. The defrost gas can be fed to the heat exchanger 3 so that is injected at a section of the heat exchanger having hardway fins 19 and is also forced to pass through the heat exchanger 3 to defrost at least the hardway fins 19 and easyway fins 15*z* of the heat exchanger.

The oxygen and nitrogen fluids discussed herein are examples. The nitrogen rich vapor is an example of a first fluid that can be fed to the heat exchanger 3 and the oxygen rich liquid is an example of a second fluid that can be fed to the heat exchanger 3. The nitrogen rich vapor inlet conduit 2 can be considered a first fluid inlet conduit for a first fluid and the oxygen rich liquid inlet conduit 4 can be considered a second fluid inlet conduit for a second fluid. The nitrogen output conduit 9 can be considered a first output conduit for the first fluid and the oxygen output conduit 7 can be considered a second output conduit for the second fluid or first portion of the second fluid. Another oxygen output conduit 7*a* (when present) can be considered a third output conduit for a second portion of the second fluid.

It should therefore be appreciated that the nitrogen rich flow passed through the heat exchanger 3 can be considered a first flow of fluid passing through the heat exchanger 3 and the oxygen rich flow can be considered a second flow of fluid within the heat exchanger 3. Alternatively, the oxygen rich flow can be considered a first flow of fluid passing within the heat exchanger 3 and the nitrogen rich flow can be considered a second flow of fluid passing through the heat exchanger 3. It should also be understood that each flow of fluid can move in a first flow of fluid direction FF in a co-current flow arrangement or one fluid can flow in the first flow of fluid direction FF while the other fluid flows in a second flow of fluid direction that is opposite the first flow of fluid direction FF in a counter current flow arrangement.

In some embodiments, the first flow of fluid direction FF can be a downward direction and an opposite direction to this flow of fluid direction can be an upward direction. In other embodiments, the first flow of fluid direction FF can be an upward direction and an opposite direction to this flow of fluid direction can be a downward direction.

Figure 1:
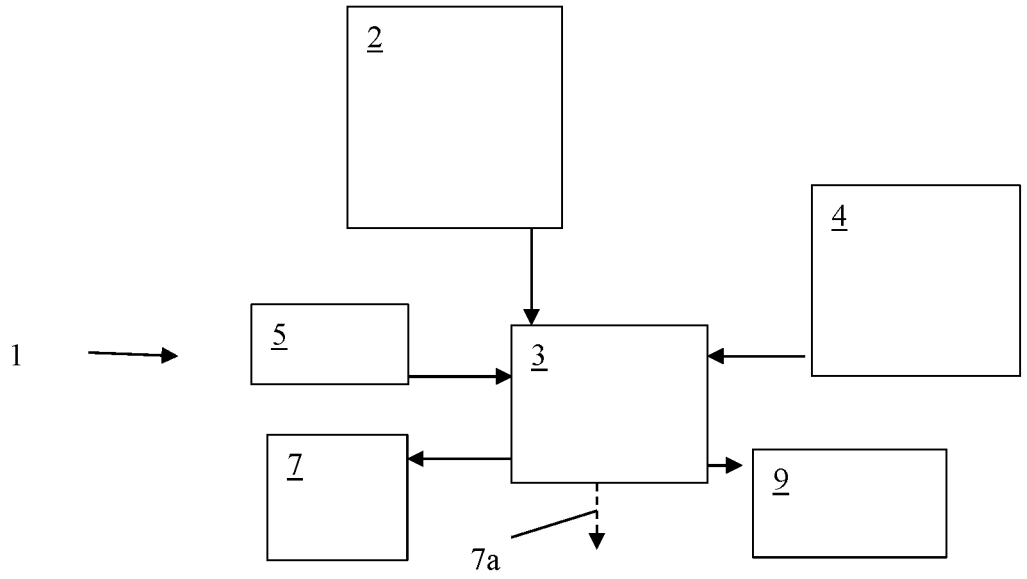
FIG. 1 is a schematic block diagram of an exemplary embodiment of a plant 1 that includes at least one heat exchanger 3.
Figure 2:
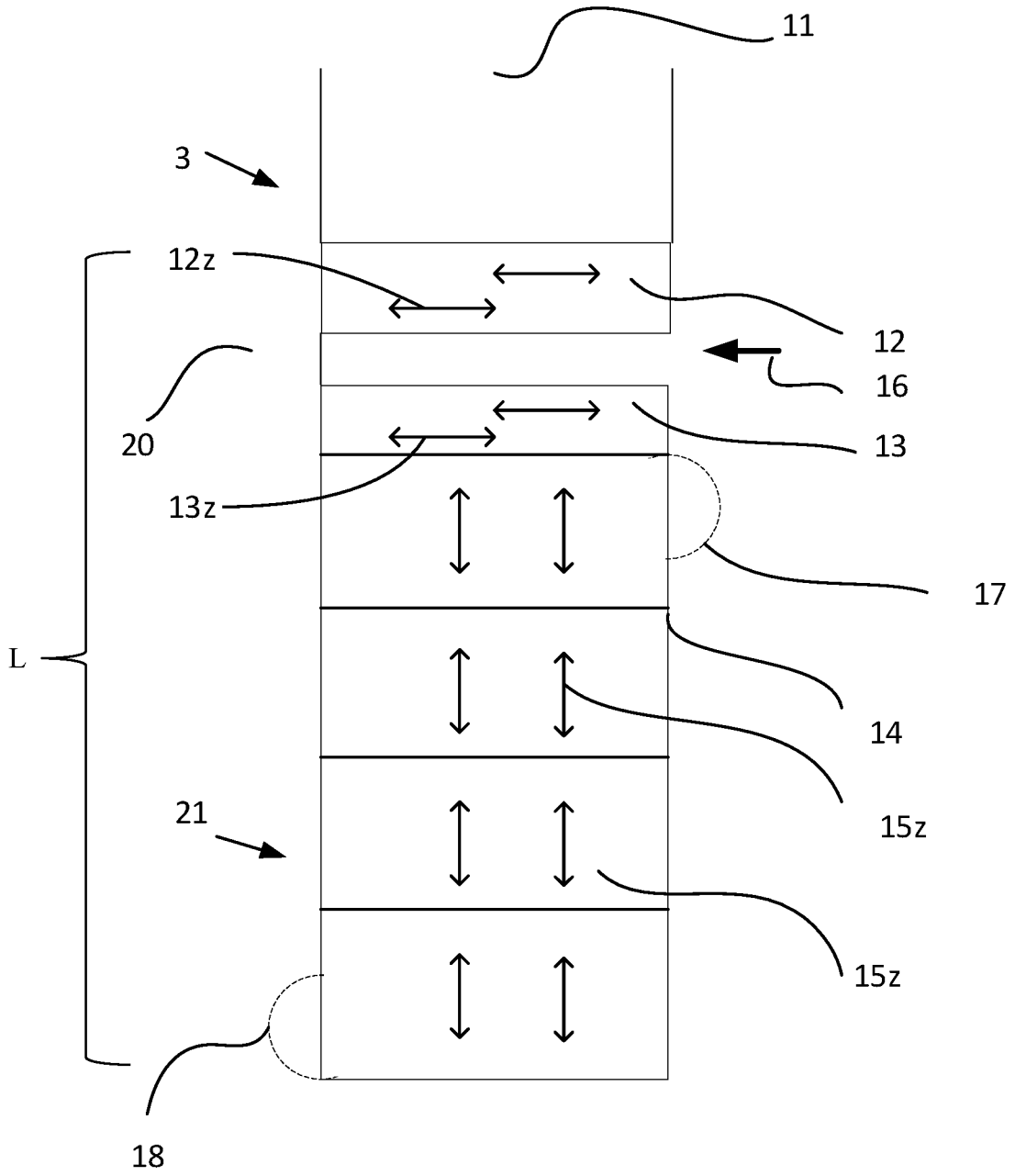
FIG. 2 is a schematic block diagram of the first exemplary embodiment of the heat exchanger utilized in the exemplary embodiment of the plant.
Figure 3:
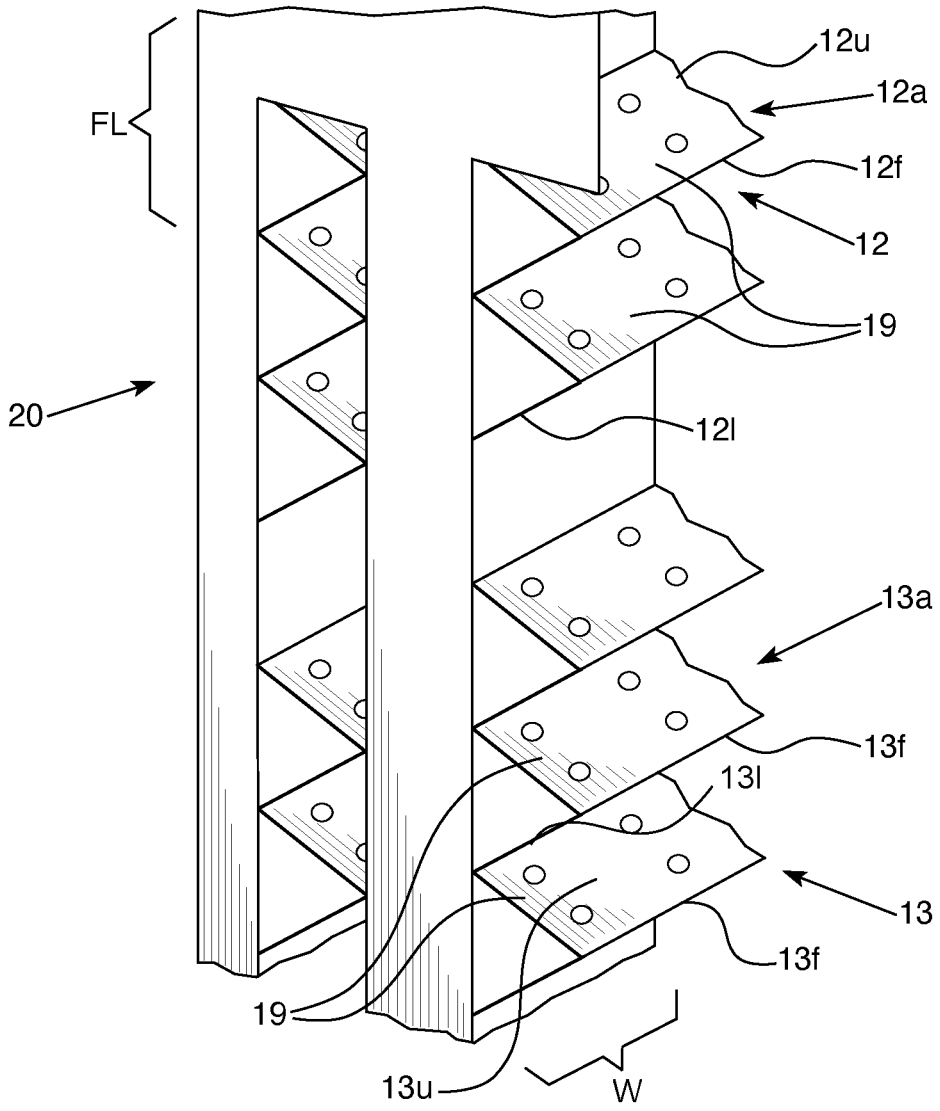
FIG. 3 is a fragmentary perspective view of the first exemplary embodiment of the heat exchanger that illustrates an exemplary upper portion of the heat exchanger having first and second sections of hardway fins positioned therein. All the sections of the hardway fins can be positioned above all the easyway fins.
Figure 4:
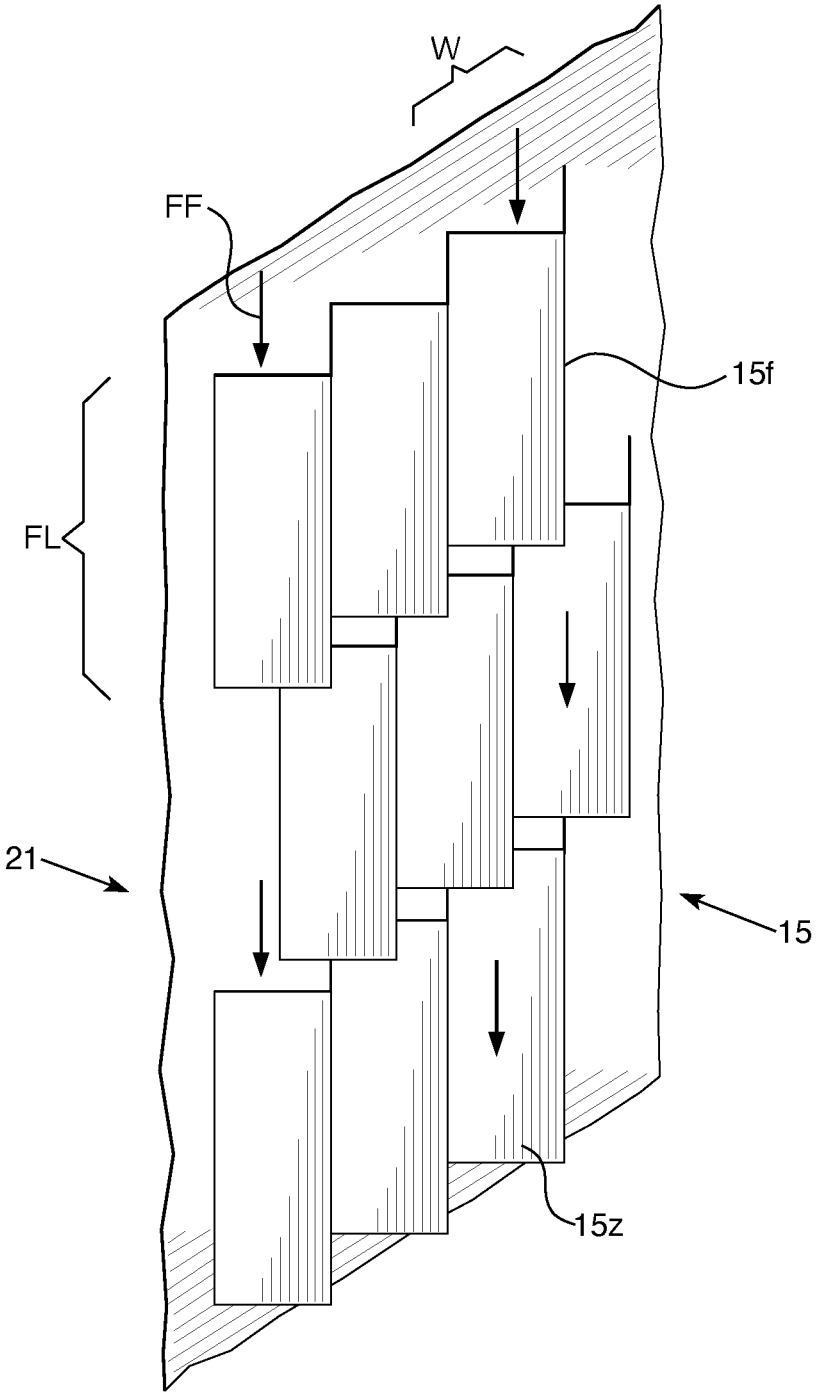
FIG. 4 is a fragmentary perspective view of the first exemplary embodiment of the heat exchanger that illustrates a lower portion of the heat exchanger having easyway fins positioned therein. The easyway fins can be positioned below all the sections of the hardway fins.

As may best be appreciated from FIGS. 2-4, the heat exchanger 3 can include a head tank 11 positioned at the top of at an upper portion 20 of the body 14 of the heat exchanger 3. The tank 11 can be a reservoir, a vessel, or other type of tank that can retain a fluid (e.g. a liquid or a gas). The heat exchanger 3 can also include a plurality of hardway fin sections between the head tank 11 and easyway fins 15*z* of an easyway fin section 15 of the heat exchanger 3 that is positioned in a lower portion 21 of the body 14 of the heat exchanger 3. In some embodiments, the head tank 11 can be connected to or otherwise include one or more distribution devices which can be one or more nozzles, sprayers, or other type of feed devices that can be in fluid communication with the tank 11 for directing the fluid (e.g. liquid and/or gas) from the head tank 11 into the body 14 of the heat exchanger in a first fluid feed output stream for feeding the fluid into the heat exchanger 3.

Other embodiments may not utilize any type of distribution device. The hardway fins 19 can be positioned and arranged so that the distribution devices are not needed in some embodiments. In such embodiments, the fluid from the tank 11 may be passed to the hardway fins 19 via at least one tank conduit or via at least one tank outlet of the tank 11. For instance, there can be a tank outlet that provides an open fluid communication between the tank 11 and the hardway fins 19 for feeding fluid from the tank 11 to the hardway fins 19 (e.g. via a direct feeding of the fluid via at least one tank outlet of the tank 11 that is configured so that fluid is directly passable from a lower portion of the tank 11 to the first section 12 of the first hardway fins 12*z* or via at least one tank outlet conduit for passing the fluid from the tank to the body 14 for directing the fluid toward the first section 12 of the first hardway fins 12*z*).

The fluid can be fed into the body 14 of the heat exchanger 3 via the fluid distribution devices or via at least one tank outlet or tank outlet conduit for passing through the body 14 for contacting the hardway fins 19 and moving along the first flow of fluid direction FF within the body 14 of the heat exchanger along a length L of the body 14 from an upper portion of the body toward a lower portion of the body (the length L of the body 14 can also be considered the height of the body). The fluid output from the tank 11 (e.g. oxygen rich liquid, another type of fluid) can contact the hardway fins 19 within the heat exchanger 3 and spread out along the widths W of the bodies of the hardway fins 19 in a direction that is transverse or parallel to the first flow of fluid direction FF. The hardway fins 19 can include holes through which the fluid can pass onto other hardway fins and/or easyway fins 15*z* that can be positioned downstream as the fluid moves along the length L of the body 14 in the first flow of fluid direction FF (e.g. oxygen rich liquid can contact the hardway fins and pass along the hardway fins' bodies and pass through holes therein).

The hardway fins 19 of the hardway fin sections can include hardway fins 19 of a first section 12 of hardway fins that is positioned above hardway fins 19 of a second section 13 of hardway fins 19. The hardway fins 19 of the first section 12 of hardway fins can be referred to as first hardway fins 12*z*. The hardway fins of the second section 13 of hardway fins can be referred to as second hardway fins 13*z*. The first hardway fins 12*z* can be considered upper hardway fins of an upper section of the hardway fins and the second hardway fins 13*z* can be considered lower hardway fins of a lower section of the hardway fins. In some embodiments, there may be additional sections of hardway fins between the first and second sections of hardway fins as well (e.g. a third section of third hardway fins, a fourth section of fourth hardway fins, etc.).

A defrost gas inlet 16 of the defrost gas inlet conduit 5 can be positioned or defined in the body 14 of the heat exchanger 3. The defrost gas inlet 16 can be positioned to feed defrost gas between the first section 12 of hardway fins 19 and the second section 13 of the hardway fins 19.

The lower portion 21 of the heat exchanger 3 can also include an inlet header 17 of the nitrogen rich vapor inlet conduit 2 for the warmer nitrogen rich fluid for feeding the nitrogen rich fluid into the body 14 of the heat exchanger 3 in co-current flow. The condensed nitrogen rich liquid can be collected via the outlet header 18.

The hardway fins 19 can include first hardway fins 12*z* of the first section of hardway fins 12 and second hardway fins 13*z* of the second section 13 of hardway fins 19. The defrost gas can be fed into the heat exchanger 3 between these sections of hardway fins via the defrost gas inlet 16. During a defrost operation when the defrost gas is passed into the heat exchanger, the defrost gas can be fed so that it passes along the hardway fins 19 to defrost those fins while also passing along the easyway fins 15*z* of the easyway fin section 15 for defrosting those fins as well.

The hardway fins 19 can be arranged and positioned in the body 14 so that the first hardway fins 12*z* are between the distribution devices and the second hardway fins 13*z* or between the tank outlets or tank outlet conduits that feed the fluid to the hardway fins 19 and the second hardway fins 13*z*. The second hardway fins 13*z* can be positioned in the body 14 between the easyway fins 15*z* and the first hardway fins 12*z*.

The hardway fins 19 can be oriented in the "hardway" direction, which is where the width of the body of the hardway fins 19 are positioned so that the fin body projects outwardly toward its distal edge within the body 14 of the heat exchanger (e.g. the bodies project to distal edges 12*f* of first hardway fins 12*z* or the fin bodies extend outwardly to distal edges 13*f* of second hardway fins 13*z*). The direction at which the bodies of the hardway fins project is configured so that the widths W of the bodies of the fins are oriented to extend in a direction that is transverse to the first flow of fluid direction FF (e.g. perpendicular to the first flow of fluid direction FF, normal to the first flow of fluid direction FF, within 5° of being perpendicular to the first flow of fluid direction FF, or within 10° of perpendicular to the first flow of fluid direction FF). FIG. 3 illustrates an example of this type of orientation. The resistance to flow in the hardway fins 19 provided by the orientation of the widths W of the bodies of the hardway fins 19 function to force the fluid from the tank 11 (e.g. oxygen rich liquid) to spread across the width of each individual passage by spreading along the width W of the body of the fin. The lengths L of the hardway fins 19 can extend parallel to the flow direction of the fluid. FIG. 3 illustrates an example of the orientation of the bodies of the hardway fins 19.

The hardway fins 19 can be arranged and positioned as a corrugated sheet of material in some embodiments that defines multiple fins. In some embodiments, each of the hardway fins 19 can be of the perforated or serrated type that has an arrangement of holes defined in the body of the fin.

The easyway fins 15*z* of the easyway fin section 15 have a different orientation from the hardway fins 19. The easyway fins 15*z* can have a length FL that extends in a first flow of fluid direction FF. The widths W of the easyway fins can be oriented so the bodies of the easyway fins 15*z* provide a lower resistance to the flow of fluid as compared to the hardway fins 19. The widths W of the easyway fins can extend outwardly to their distal edges 15*f* at a direction that is relatively in-line with the first flow of fluid direction FF (e.g. at an angle that is within 30° or within 60° of being parallel to the first flow of fluid direction FF). FIG. 4 illustrates an example of this type of orientation of the bodies of the easyway fins 15*z*.

The easyway fins 15*z* can be arranged and positioned as a corrugated sheet of material in some embodiments that defines multiple fins. In some embodiments, each of the easyway fins 15*z* can be of the perforated or serrated type that has an arrangement of holes defined in the body of the fin.

The orientation of the easyway fins 15*z* can facilitate the spreading of the fluid from the tank 11 (e.g. oxygen rich liquid) to occur along the length FL of the body of the easyway fins 15*z* in a direction that is in-line with or parallel with the first flow of fluid direction FF. In contrast, the orientation of the hardway fins 19 can facilitate the spreading out of the oxygen rich liquid about the width W of the body of the hardway fins in a direction that is perpendicular to the first flow of fluid direction FF. Oxygen rich liquid or other fluid that may be sprayed or otherwise output toward the hardway fins 19 can move in the first flow of fluid direction FF so that when the fluid contacts the hardway fins bodies, the orientation of the bodies helps facilitate the fluid spreading out along the width W of the bodies in a direction that is perpendicular to the first flow of fluid direction FF or is substantially perpendicular to the first flow of fluid direction FF (e.g. within 5° of being perpendicular, within 10° of being perpendicular, within 15° of being perpendicular, etc.).

The plant 1 can be operated under a turndown condition. During this operational condition, less liquid can be produced to pass to the heat exchanger 3. Under a severe turndown condition this can result in the vapor that can be generated in the section of easyway fins 15 entering the hardway fins 19 of the heat exchanger (e.g. entering the second section of hardway fins 13 and may also pass to the first section of hardway fins 12 that is positioned above the second section). This can result in the liquid head along the heat exchanger width direction being non-uniform or significantly non-uniform, which can result in a non-even flow distribution of the fluid (e.g. oxygen rich liquid) that is significantly uneven. This type of condition can be detrimental to heat exchanger operational efficiency. For a liquid oxygen (LOX) heat exchanger, counter-current vapor/liquid flow can lead to the concentration of hydrocarbon impurities, which can cause safety concerns.

During turndown operations, the decreased amount of liquid that is passed to the heat exchanger 3 can require the resistance in hardway fins to be increased so that the passage-to-passage distribution can remain uniform. For heat exchangers with low turndown requirements, we determined that this increase in hardway fin resistance can lead to very tall head tanks to accommodate the liquid level under the design operating conditions.

We determined that an increase in the distance between holes in the width direction (e.g. direction at which width W extends for the hardway fins, which can be referred to as a hole pitch) can be provided. However, when the hole pitch is too big in the bottom section of hardway fins, the liquid may not be evenly distributed on the downstream easyway fins 15*z*, which can be detrimental to the operation of the heat exchanger.

We also determined that the hardway fins could be designed and configured so different sections of the hardway fins had different fin frequencies. The fin frequency for at least some of the hardway fins can be increased, for example so a first section of hardway fins has a higher fin frequency than at least one other section.

It should be understood that the fin frequency can refer to the fin density within the body of the heat exchanger. For example, the fin density can be defined to be the number of fins per unit length within the body of the heat exchanger. For example, for an embodiment that may have twelve fins in the length, L of a section of the body. The fin density, or fin frequency, is 12/L. A fin frequency of 6 fins per inch can refer to the fact that there are six fins per inch in a particular section of the body 14 and a fin frequency of 12 fins per inch can refer to the fact that fins arranged within a particular section of a body so that there are twelve fins per inch in that section. The greater the fin frequency number for a particular section of the hardway fins, the greater the fin density within a particular section of the body 14.

As yet another option, we also determined that resistance can also (or alternatively) be increased by reducing the hole diameter D. The hole diameter D can also be considered the width of the hole (e.g. for holes that are not circular in shape the diameter D can be considered the width). However, we also realized that a minimum hole diameter D can be needed to help avoid blockage in brazing of the fins.

We also determined that to address the turndown operational condition, a change that simply increases the pitch for holes, the fin frequency, or makes hole diameter sizing changes may not be an optimal solution. In such situations, we found that the fin geometry of the first section 12 of hardway fins, which can be considered a top section or upper section of the hardway fins 19 closest to the distribution devices or tank feed outlet(s) or tank feed conduit(s), can be designed to be different from the fin geometry of the lower section(s) of hardway fins, such as the second section 13 of hardway fins 13. This type of change was found to provide flexibility in the downflow heat exchanger design by allowing the heat exchanger 3 to be designed for the turndown operation condition by providing an upper section of hardway fins that can provide increased resistance for helping to maintain a minimum liquid level in the tank during a turndown operation of a plant while having a lower section of hardway fins configured to provide a relatively even, or uniform flow distribution of the liquid to downstream easyway fins 15*z*.

We determined that this approach can provide larger turndown flexibility for a fixed head tank height. This approach can allow heat transfer resistance of the hardway fins 19 to be better controlled for turndown operational flexibility. This approach can also provide a more desired hardway fin resistance for turndown operational conditions. Finally, this approach can provide cost savings in head tank height by permitting a tank 11 to be utilized that has a smaller height. This tank height reduction can be significant in some embodiments—particularly embodiments that have a large turndown requirement.

In embodiments of our heat exchanger 3 having this type of hardway fin arrangement for, there can be at least two sections of hardway fins. A first section of the hardway fins 12 that include the first hardway fins 12*z* can be configured to provide the backpressure to build up sufficient liquid level in the liquid tank. The second section of hardway fins 13 can be positioned downstream of the first upper section and can be configured so that the second hardway fins 13*z* of this section are able to provide the backpressure to build up sufficient liquid level in the liquid tank and facilitate fluid distribution for distributing the fluid from the tank 11 (e.g. oxygen rich liquid) evenly on the downstream easyway fins 15*z*. In such embodiments, the first section 12 of the first hardway fins 12*z* can be arranged, sized, and configured so that this section of hardway fins have a first flow resistance per unit length L of the body that is greater than a second flow resistance per unit length L of the body 14 of the second section 13 of the second hardway fins 13*z*. In other embodiments, it is contemplated that the first section 12 of the first hardway fins 12*z* can be arranged, sized, and configured so that this section of hardway fins have a first flow resistance per unit length L of the body that is less than a second flow resistance per unit length L of the body 14 of the second section 13 of the second hardway fins 13*z*.

The differences in flow resistance between the different sections of the hardway fins 19 can be defined by the hardway fins in these different sections having a different hole density per unit length. As can be appreciated from the examples discussed herein, the different hole densities can be defined by the holes of the hardway fins differing in hole diameter and/or hole pitch. The different flow resistances can also be defined by the fin frequencies of these sections differing. This difference in fin frequencies can be provided in combination with the hole densities differing or as an alternative to the hole densities of the hardway fins being different.

Examples of the different type of hardway fin configurations for the first and second hardway fins 12*z* and 13*z* of the first and second sections of hardway fins 12 and 13 positioned in the heat exchanger 3 may best be appreciated from FIGS. 5 and 6. In these embodiments, the first section 12 of the first hardway fins 12*z* and the second section 13 of the second hardway fins 13*z* can be arranged, sized, and configured so that the first section 12 of first hardway fins 12*z* have a first flow resistance per unit length L of the body that is greater than or less than a second flow resistance per unit length L of the body 14 of the second section 13 of the second hardway fins 13*z*.

FIG. 5 illustrates a first hardway fin body configuration having a first arrangement of holes 30. The holes are spaced apart from each other along a first axis z and a second axis x to define rows of holes that extend along the second axis x and columns of holes that extend along the first axis z. Each of the holes has a diameter D that can define the size of the hole in the body of the hardway fin.

The holes are spaced apart to define an arrangement of rows and columns of holes that extend along the first and second axes z and x. For example, the holes are spaced apart in a width direction so that immediately adjacent holes in a row of holes are each spaced apart by a first distance dx. The first distance dx can be considered a first hole pitch dx. The first hole pitch dx between immediately adjacent holes can be a linearly extending distance between the immediately adjacent holes or the centers of those immediately adjacent holes along the sheet of material that forms the hardway fin body.

The holes are spaced apart in a length direction (which can also be considered a height direction) as well to define columns of holes. Immediately adjacent holes in a column of holes can be spaced apart in by a second distance dz that extend along the length FL or height of the hardwayfin. The second distance dz can be considered a second hole pitch dz. The second hole pitch dz between immediately adjacent holes can be a linearly extending distance between the immediately adjacent holes or the centers of those immediately adjacent holes along the sheet of material that forms the hardway fin body. The linearly extending distance of the second hole pitch dz can be perpendicular or substantially perpendicular to the linearly extending distance of the first hole pitch dx (e.g. be perpendicular, be within 5° of being perpendicular, be within 10° of being perpendicular).

Hardway fins 19 can be formed from a sheet of material (e.g. metal, brazed aluminum, etc.) by folding a sheet of material having the exemplary first arrangement of holes 30 along the first axis z of the sheet. The folding can be performed by folding or bending the sheet of material to define a distal edge (e.g. distal edge 12*f* or distal edge 130 at the location of folding, or bending. Such folding can result in there being a first fin body 30*u* and a second fin body 301 each extending away from the distal edge defined by the folding. The first fin body 30*u* can be positioned above the second fin body 301 (or vice versa) when the hardway fins are positioned in the body 14 of the heat exchanger 3. For instance, the first fin body 30*u* can be an upward facing fin 12*u* of the first section of hardway fins 12 and the second fin body 301 can be a downwardly facing fin 121 of the first section of hardway fins 12. As another example, the first fin body 30*u* can be an upward facing fin 13*u* of the second section of hardway fins 13 and the second fin body 301 can be a downwardly facing fin 13*l* of the second section of hardway fins 13.

FIG. 6 illustrates a second hardway fin body configuration having a second arrangement of holes 31. The holes are spaced apart from each other along a first axis z and a second axis x to define rows of holes that extend along the second axis x and columns of holes that extend along the first axis z. Each of the holes has a diameter D that can define the size of the hole in the body of the hardway fin.

The holes are spaced apart to define an arrangement of rows and columns of holes that extend along the first and second axes z and x. For example, the holes are spaced apart in a width direction so that immediately adjacent holes in a row of holes are each spaced apart by a first distance dx, which can also be considered a first hole pitch. The holes are spaced apart in a length direction as well to define columns of holes. Immediately adjacent holes in a column of holes can be spaced apart in by a second distance dz, which can be considered a second hole pitch dz. The first hole pitch dx between immediately adjacent holes of a row of holes can be a linearly extending distance that extends between those holes or the centers of those holes along the sheet of material that forms the fin body. The second hole pitch dz between immediately adjacent holes can be a linearly extending distance between the immediately adjacent holes or the centers of those immediately adjacent holes along the sheet of material that forms the hardway fin body. The linearly extending distance of the second hole pitch dz can be perpendicular or substantially perpendicular to the linearly extending distance of the first hole pitch dx (e.g. be perpendicular, be within 5° of being perpendicular, be within 10° of being perpendicular).

Hardway fins 19 having this second arrangement of holes 31 can be formed from a sheet of material (e.g. metal, brazed aluminum, etc.) by folding a sheet of material having the exemplary first arrangement of holes 30 along the first axis z of the sheet. The folding can be performed by folding or bending the sheet of material to define a distal edge (e.g. distal edge 12*f* or distal edge 130 at the location of folding, or bending. Such folding can result in there being a first fin body 31*u* and a second fin body 311 each extending away from the distal edge defined by the folding. The first fin body 31*u* can be positioned above the second fin body 311 (or vice versa) when the hardway fins are positioned in the body 14 of the heat exchanger 3.

For instance, the first fin body 31*u* can be an upward facing fin 12*u* of the first section of hardway fins 12 and the second fin body 31*l* can be a downwardly facing fin 121 of the first section of hardway fins 12. As another example, the first fin body 31*u* can be an upward facing fin 13*u* of the second section of hardway fins 13 and the second fin body 31*l* can be a downwardly facing fin 13*l* of the second section of hardway fins 13.

It should be appreciated that hardway fins 19 formed via a sheet of material having the first or second exemplary hole arrangements 30 or 31 can be bent or folded to multiple different spaced apart locations along the same axis of the sheet to define a corrugated sheet of material having multiple distal edges (e.g. distal edges 12*f* or distal edges 130 that defines multiple hardway fins 19 that are integrally attached to each other. In other embodiments, a sheet may only be bent a single time to define first and second hardway fins 19 that are joined at a single distal edge defined by the folding or bending of the sheet of material along an axis of the sheet (e.g. first axis z or second axis x).

The first hardway fins 12*z* can be formed via folding of a first sheet of material having the first hole arrangement 30 or the second hole arrangement 31 so that the first hole pitch dx of the first hardway fins 12*z* can be a distance about which immediately adjacent holes are spaced apart in a width direction so that immediately adjacent holes in a row of holes are each spaced apart by a first distance for the first hardway fins. The first sheet of material that is folded can also have the holes arranged so that the second hole pitch dz of the first hardway fins 12*z* is a distance about which immediately adjacent holes are spaced apart in a length direction so that immediately adjacent holes in a column of holes are each spaced apart by a second distance (which can also be considered a third distance or a fourth distance) for the first hardway fins. The folding of the first sheet of material can include one or more spaced apart folds to form distal edges 12*f* of the first hardway fins 12*z*. The folds can be made at spaced apart locations along an axis of the first sheet of material (e.g. the first axis z or the second axis x).

A second sheet of material can be folded to make second hardway fins 13*z* as well. The second sheet of material can have the first hole arrangement 30 or the second hole arrangement 31 and provided so that the first hole pitch dx of the second hardway fins 13*z* is a distance about which immediately adjacent holes are spaced apart in a width direction so that immediately adjacent holes in a row of holes are each spaced apart by a second distance for the second hardway fins 13*z* (which can alternatively be considered a third distance). The second sheet of material's holes can also be arranged so that the second hole pitch dz of the sheet of material is a distance about which immediately adjacent holes are spaced apart in a length direction so that immediately adjacent holes in a column of holes are each spaced apart by a fourth distance for the second hardway fins 13*z*.

The folding of the second sheet of material can include one or more spaced apart folds to form distal edges 13*f* of the second hardway fins 13*z*. The folds can be made at spaced apart locations along an axis of the second sheet of material (e.g. the first axis z or the second axis x).

It should be appreciated that the first, second, third, and fourth distances concerning the first and second hole pitches of the first and second sheets of material referenced herein can all be similar distances or different differences as previously discussed herein. The hole diameters D of the holes of the first and second sheets of material used to form the first and second hardway fins 12*z* and 13*z* can also be similar diameters or different diameters as previously discussed herein.

Each of the first hardway fins 12*z* can have the first hole arrangement 30 or the second hole arrangement 31. The second hardway fins 13*z* can have the first hole arrangement 30 or the second hole arrangement 31 as well. But, the hole arrangement of the second hardway fins 13*z* can differ from the hole arrangement of the first hardway fins 12*z* in at least one of four different ways: (i) the hole diameters D can differ, (ii) the first hole pitch dx can differ, (iii) the second hole pitch dz can differ, and (iv) the fin frequency can differ (e.g. fins per unit length L, fins per inch, or fins per cm within the upper portion of the heat exchanger differ for the first and second sections 12 and 13 of the first and second hardway fins 12*z* and 13*z*, etc.). In some embodiments, all of these different hole arrangement parameters (i)-(iv) may differ. In other embodiments only one of these parameters may differ or only two of these parameters may differ (e.g. hole diameter D and first hole pitch dx may differ, hole diameter D and the second hole pitch dz may differ, or the first pitch dx and second hole pitch dz may differ).

For example, the first fin frequency for the first hardway fins 12*z* of the first section of hardway fins 12 can be a greater value than the second fin frequency for the second hardway fins 13*z* of the second section of hardway fins 13. The fin density of the first fins 12*z* can be greater than the fin density of the second fins 13*z* such that there is a greater flow resistance per unit length L in the first section 12 of first hardway fins 12*z* than the flow resistance per unit length L present in the second section 13 of second hardway fins 13*z*. In other embodiments, the first fin frequency for the first hardway fins 12*z* of the first section of hardway fins 12 can be a lesser value than the second fin frequency for the second hardway fins 13*z* of the second section of hardway fins 13. The fin density of the first fins 12*z* can be less than the fin density of the second fins 13*z* such that there is a greater flow resistance per unit length L in the second section 13 of second hardway fins 13*z* than the flow resistance per unit length L present in the first section 12 of first hardway fins 12*z*.

As another example, in some embodiments, the lower second section of hardway fins 13 can include second hardway fins 13*z* that have a smaller first hole pitch dx than the first hole pitch dx of the first hardway fins 12*z* of the upper first section of hardway fins 13. The second hole pitch dz and hole diameters D can be the same for the first and second hardway fins 12z and 13z. The fin frequencies for the first and second sections 12 and 13 of the first and second hardway fins 12z and 13z can be the same or can differ in these embodiments.

As another example, the lower second section of hardway fins 13 can include second hardway fins 13z that have a larger first hole pitch dx than the first hardway fins 12z of the first section of hardway fins 12. The second hole pitch dz and hole diameters D dz can be the same for the first and second hardway fins 12z and 13z. The fin frequencies for the first and second sections 12 and 13 of the first and second hardway fins 12z and 13z can be the same or can differ in these embodiments.

As yet another example, the lower second section of hardway fins 13 can include second hardway fins 13z that have a smaller or a larger hole diameter, D, than the hole diameter D of the holes of the first hardway fins 12z of the upper first section of hardway fins 12. The first and second hole pitches dx and dz can be the same for the first and second hardway fins 12z and 13z. The fin frequencies for the first and second sections 12 and 13 of the first and second hardway fins 12z and 13z can be the same or can differ in these embodiments.

As yet another example, the lower second section of hardway fins 13 can include second hardway fins 13z that have a smaller or a larger second hole pitch dz, than the second hole pitch dz of the first hardway fins 12z of the first section of hardway fins 12. The first hole pitch dx and hole diameters D can be the same for the first and second hardway fins 12z and 13z. The fin frequencies for the first and second sections 12 and 13 of the first and second hardway fins 12z and 13z can be the same or can differ in these embodiments.

As yet another example, the lower second section of hardway fins 13 can include second hardway fins 13z that have a smaller or a larger first hole pitch dx and a smaller or a larger hole diameter D than the first hole pitch dx and hole diameter D of the first hardway fins 12z of the first section of hardway fins 12. The second hole pitch dz can be the same for the first and second hardway fins 12z and 13z. The fin frequencies for the first and second sections 12 and 13 of the first and second hardway fins 12z and 13z can be the same or can differ in these embodiments.

As yet another example, the lower second section of hardway fins 13 can include second hardway fins 13z that have a smaller or a larger first hole pitch dx, a smaller or a larger hole diameter D and a smaller or larger second hole pitch dz than the first hole pitch dx, hole diameter D, and second hole pitch dz of the first hardway fins 12z of the first section of hardway fins 12. The fin frequencies for the first and second sections 12 and 13 of the first and second hardway fins 12z and 13z can be the same or can differ in these embodiments.

The first hardway fins 12z can be configured to provide a pressure drop through the hardway fins that is 0.25-10 times the length FL of the hardway fin when the friction pressure drop is expressed as inches of liquid. The second hardway fins 13z can be configured to provide a pressure drop through the hardway fins that is 0.25-10 times, and preferably 1-5 times the length FL of the hardway fin when the friction pressure drop is expressed as inches of liquid. The length FL of the hardway fin can also be considered the height of the hardway fin. In addition to width W and length FL (which can also be considered the height), each hardway fin can also have a thickness. The thickness can be selected to meet a particular set of design criteria.

In some embodiments, the first hardway fins 12z can have a maximum first hole pitch dx of 50 millimeters (mm) (e.g. the first hole pitch can be 50 mm or less than 50 mm) and a maximum first hole pitch dx for the second hardway fins 13z can be 10 mm (e.g. the first hole pitch dx can be 10 mm or less than 10 mm). Based on conducted experimentation, we have found that this maximum first hole pitch dx design criteria setting can allow for the second hardway fins 13z to facilitate improved fluid flow distribution on the easyfins 15z (e.g. liquid flow distribution or gas flow distribution) by facilitating a more even flow distribution of the fluid flow on the easyfins 15z as the fluid flow flows through the body 14 of the heat exchanger in a flow direction (e.g. the first flow of fluid direction FF) during turndown operations as well as providing the same, if not better, performance during non-turndown operations.

In some embodiments, the first hardway fins 12z can have a maximum second hole pitch dz that is sized so that each upward facing hardway fin and each downward facing hardway fin has at least one hole. The maximum second hole pitch dz can be dependent on the length of the fin or height of the fin to meet this criteria. For a hardwayfin that has a length or height of 10 mm, the maximum second hole pitch dz can be 10% to 95% of the length or height (e.g. the second hole pitch dz can be in a range of 1 mm to 9.5 mm for such an embodiment). A maximum second hole pitch dz for the second hardway fins 13z can be the same or similar to the maximum second hole pitch dz of the first hardway fins 12z. However, in some embodiments, it is contemplated that the second hole pitch maximum for the second hardway fins 13z can have a different maximum from the second hole pitch maximum of the first hardway fins 12z.

In some embodiments, the first hole pitch dx for the first hardway fins 12z can each be in the 1-50 mm range. Additionally, the first hole pitch dx for the second hardway fins 13z can each be in the 1-10 mm range. The second hole pitch dz for the first hardway fins 12z can be 0.1-0.95 of the fin height or fin length (e.g. 10% to 95% of the length or height of the fin). The second hole pitch dz for the second hardway fins 13z can be 0.1-0.95 of the fin height or fin length (e.g. 10% to 95% of the length or height of the fin). The hole diameter D for the holes of the first hardway fins 12z can be in the 1-7 mm range and the hole diameter D for the holes of the second hardway fins 13z can be in the 1-7 mm range. In such embodiments or in other embodiments, the ratio for the first hole pitch dx of the second hardway fins 13z to the first hole pitch dx of the first hardway fins 12z can range from 0.1-1; a ratio of the second hole pitch dz of the second hardway fins 13z to the first hardway fins 12z can range from 0.5-1, the ratio of hole diameter D of the holes of the second hardway fins 13z to the first hardway fins 12z can range from 0.5-1, and a ratio of fin frequency of the second section of second hardway fins 13z to the fin frequency of the first section of first hardway fins 12z can range from 0.5-2.

In yet other embodiments, the first hardway fins 12z may not be perforated. Instead, the first hardway fins 12z can be serrated fins while the second hardway fins 13z are perforated to include holes. In yet other embodiments, the first hardway fins 12z may be perforated to include holes while the second hardway fins 13z are serrated fins. For such embodiments, the size and shape of the serrated hardway fins as well as the hole dimeter and hole pitches of the perforated hardway fins can be designed so that the first hardway fins 12z are configured to provide a backpressure for maintenance of a fluid level of the fluid in the tank at or above a minimum fluid level and the second hardway fins

13*z* are configured to provide a backpressure for maintenance of the fluid level of the fluid in the tank at or above the minimum fluid level and facilitate fluid distribution for distributing the first fluid on the easyway fins.

It is also possible that in some embodiments the first and second hardway fins 12*z* and 13*z* are serrated fins or that these sections of hardway fins are not perforated and do not include holes. For such embodiments, the fin frequency can be adjusted as well as the shape and sizing of the first and second hardway fins 12*z* and 13*z* so that the first hardway fins 12*z* are configured so that the flow resistance per unit length of these sections of hardway fins differ while the first section of the hardway fins are configured and positioned to provide a backpressure for maintenance of a fluid level of the fluid in the tank at or above a minimum fluid level and the second hardway fins 13*z* are positioned and configured to provide a backpressure for maintenance of the fluid level of the fluid in the tank at or above the minimum fluid level and facilitate fluid distribution for distributing the first fluid on the easyway fins.

In many embodiments (and as discussed above) the first hardway fins 12*z* can have one or more of (i) the first hole pitch dx, (ii) second hole pitch dz, (iii) hole diameter D, and (iv) the fin frequency differ from that same parameter of the second hardway fins 13*z*. These differences in structure and/or arrangement of the first and second hardway fins 12*z* and 13*z* can be provided so that a flow resistance per unit length of the first section 12 of first hardway fins 12*z* differs from a flow resistance per unit length of the second section 13 of second hardway fins 13*z*. We have also found that the above referenced design criteria ranges for the first hole pitch dx, second hole pitch dz, hole diameters D, and fin frequencies for the first and second hardway fins 12*z* and 13*z* can allow for the first and second hardway fins 12*z* and 13*z* to provide the backpressure to build up sufficient liquid level in the liquid tank and facilitate improved fluid flow distribution of fluid from tank 11 on the easyfins 15*z* by facilitating a more even flow distribution of the fluid flow on the easyfins 15*z* as the fluid flow flows through the body 14 of the heat exchanger in a flow direction (e.g. the first flow of fluid direction FF) during turndown operations as well as providing the same, if not better, performance during non-turndown operations.

That being said, it is contemplated that in yet other embodiments, different ranges for the first hole pitch dx, second hole pitch dz, hole diameters D, and fin frequency, can be utilized to meet a particular set of design criteria. In many embodiments, these hardway fin design criteria can be adjusted so that the resistance in the first section 12 of the first hardway fins 12*z* is 0.25-10 times the hardway fin length FL, or height (and preferably 1-5 times the hardway fin length FL or hardway fin height) and the flow resistance in the second section 13 of the second hardway fins 13*z* is 1-5 time the hardway fin length FL or height when the friction pressure drop is expressed as inches of liquid.

Embodiments of our heat exchanger 3, hardway fin arrangements for the heat exchanger 3, plants utilizing the heat exchanger 3 and methods of making and using the same can be varied from the examples discussed herein to meet a particular set of design criteria that may be developed for a particular specific application. It should therefore be appreciated that modifications to the embodiments explicitly shown and discussed herein can be made to meet a particular set of design objectives or a particular set of design criteria. For example, the flow rate, pressure, and temperature of the first and second fluids (e.g. nitrogen rich vapor and oxygen rich liquid) passed through the heat exchanger 3 can vary to account for different plant design configurations and other design criteria. As yet another example, the body 14 of the heat exchanger 3 can utilize different types of conduits (e.g. pipes, tubing, valves, connectors, etc.) for the passing of the different flows of fluid for heat transfer therein. The plant 1 can be configured as an air separation plant or other type of plant in which at least one heat exchanger can be utilized. The plant 1 and the heat exchanger 3 can each be configured to include process control elements positioned and configured to monitor and control operations (e.g. temperature and pressure sensors, flow sensors, an automated process control system having at least one work station that includes a processor, non-transitory memory and at least one transceiver for communications with the sensor elements, valves, and controllers for providing a user interface for an automated process control system that may be run at the work station and/or another computer device of the plant, etc.). As another example, in some embodiments there may be additional sections of hardway fins between the first and second sections of hardway fins as well that may each be different sections of hardway fins that each define a different flow resistance per unit length as compared to the other hardway fins sections. For instance, in some embodiments, there can be a third section of third hardway fins having a third flow resistance per unit length L of the body 14 between the first section 12 of first hardway fins 12*z* having a first flow resistance per unit length L of the body 14 and the second section 13 of second hardway fins 13*z* having a second flow resistance per unit length L of the body 14; a fourth section of fourth hardway fins having a fourth flow resistance per unit length L of the body that is positioned between the third section of third hardway fins and the first section 12 of first hardway fins or the second section 13 of second hardway fins 13*z* (and where the first, second, third, and fourth flow resistances per unit length L of the body are different, etc.).

As another example, it is contemplated that a particular feature described, either individually or as part of an embodiment, can be combined with other individually described features, or parts of other embodiments. The elements and acts of the various embodiments described herein can therefore be combined to provide further embodiments. Thus, while certain exemplary embodiments of the heat exchangers, hardway fin arrangements for heat exchangers, plants having at least one heat exchanger that includes an embodiment of our hardway fin arrangement, and methods of making and using the same have been shown and described above, it is to be distinctly understood that the invention is not limited thereto but may be otherwise variously embodied and practiced within the scope of the following claims.

What is claimed is:

1. A heat exchanger comprising:

a body connected to a tank configured to retain a first fluid;

a first section of first hardway fins positioned in the body adjacent to a position at which the first fluid is fed into the body for passing toward the first hardway fins;

a second section of second hardway fins positioned in the body such that that first hardway fins are positioned between the second hardway fins and the position at which the first fluid is fed into the body;

the first hardway fins configured to provide a backpressure for maintenance of a fluid level of the first fluid in the tank at or above a minimum fluid level;

the second hardway fins configured to provide a backpressure for maintenance of the fluid level of the first fluid in the tank at or above the minimum fluid level and facilitate fluid distribution for distributing the first fluid on a plurality of easyway fins, the easyway fins being positioned in the body of the heat exchanger such that the second hardway fins are located between the first hardway fins and the easyway fins; and the first section of the first hardway fins and the second section of the second hardway fins positioned and configured so that a first flow resistance per unit length of the body for the first section of the first hardway fins differs from a second flow resistance per unit length of the body for the second hardway fins; and wherein:

each of the first hardway fins configured to provide the backpressure for maintenance of the fluid level in the tank by having holes in a body of the first hardway fin, the holes having a first hole pitch and a second hole pitch that define spacing between immediately adjacent holes, each of the holes having a hole diameter, the first section of first hardway fins also having a first fin frequency; and each of the second hardway fins configured to provide the backpressure for maintenance of the fluid level in the tank and facilitate fluid distribution for distributing the first fluid on easyway fins by having holes in a body of the second hardway fin, the holes of the second hardway fins having a first hole pitch and a second hole pitch that define spacing between immediately adjacent holes, each of the holes of the second hardway fins having a hole diameter, the second section of second hardway fins also having a second fin frequency; and the second fin frequency differs from the first fin frequency.

2. The heat exchanger of claim 1, wherein the first hole pitch of the holes of the first hardway fins differ from the first hole pitch of the holes of the second hardway fins.

3. The heat exchanger of claim 1, wherein the second hole pitch of the holes of the first hardway fins differ from the second hole pitch of the holes of the second hardway fins.

4. The heat exchanger of claim 1, wherein the hole diameter of the holes of the first hardway fins differs from the hole diameter of the of the holes of the second hardway fins.

5. The heat exchanger of claim 1, wherein:

the first hole pitch of the holes of the first hardway fins differ from the first hole pitch of the holes of the second hardway fins; and the second hole pitch of the holes of the first hardway fins differ from the second hole pitch of the holes of the second hardway fins.

6. The heat exchanger of claim 1, wherein:

the first hole pitch of the holes of the first hardway fins differ from the first hole pitch of the holes of the second hardway fins; and the hole diameter of the holes of the first hardway fins differs from the hole diameter of the holes of the second hardway fins.

7. The heat exchanger of claim 1, wherein:

the second hole pitch of the holes of the first hardway fins differ from the second hole pitch of the holes of the second hardway fins; and the hole diameter of the holes of the first hardway fins differs from the hole diameter of the holes of the second hardway fins.

8. The heat exchanger of claim 1, wherein:

the first hole pitch of the holes of the first hardway fins differ from the first hole pitch of the holes of the second hardway fins;

the second hole pitch of the holes of the first hardway fins differ from the second hole pitch of the holes of the second hardway fins;

the hole diameter of the holes of the first hardway fins differs from the hole diameter of the holes of the second hardway fins.

9. The heat exchanger of claim 1, wherein the first hole pitch of the holes of the first hardway fins is a maximum of 50 mm and the first hole pitch of the second hardway fins is a maximum of 10 mm.

10. The heat exchanger of claim 9, wherein the second hole pitch of the holes of the first hardway fins is 0.1-0.95 of a fin height of the first hardway fins and the second hole pitch of the second hardway fins is 0.1-0.95 of a fin height of the second hardway fins.

11. The heat exchanger of claim 1, wherein the second hole pitch of the holes of the first hardway fins is 0.1-0.95 of a fin height of the first hardway fins and the second hole pitch of the second hardway fins is 0.1-0.95 of a fin height of the second hardway fins.

12. The heat exchanger of claim 1, wherein:

the first hole pitch of the first hardway fins is a distance about which immediately adjacent holes are spaced apart in a width direction so that immediately adjacent holes in a row of holes are each spaced apart by a first distance for the first hardway fins; and the first hole pitch of the second hardway fins is a second distance about which immediately adjacent holes are spaced apart in a width direction so that immediately adjacent holes in a row of holes are each spaced apart by a second distance for the second hardway fins.

13. The heat exchanger of claim 1, wherein the second hole pitch of the first hardway fins is a distance about which immediately adjacent holes are spaced apart in a length direction so that immediately adjacent holes in a column of holes are each spaced apart by a first distance for the first hardway fins; and the second hole pitch of the second hardway fins is a distance about which immediately adjacent holes are spaced apart in a length direction so that immediately adjacent holes in a column of holes are each spaced apart by a second distance for the second hardway fins;

wherein the first distance is 0.1-0.95 to a fin height of the first hardway fins and the second distance is 0.1-0.95 to a fin height of the second hardway fins.

14. A hardway fin arrangement for a heat exchanger comprising:

a first section of first hardway fins positionable in a body of a heat exchanger adjacent to a position at which a first fluid from a tank is fed into the body;

a second section of second hardway fins positionable in the body such that that first hardway fins are locatable between the second hardway fins and the position at which the first fluid from the tank is fed into the body;

the first hardway fins configured to provide a backpressure for maintenance of a fluid level of the first fluid in the tank;

the second hardway fins configured to provide a backpressure for maintenance of the fluid level of the first fluid in the tank and facilitate fluid distribution for distributing the first fluid on a plurality of easyway fins locatable in the body of the heat exchanger such that the second hardway fins are located between the first hardway fins and the easyway fins; and the first section of the first hardway fins and the second section of the second hardway fins are positioned and configured so that a first flow resistance per unit length of the first section of the first hardway fins differs from a second flow resistance per unit length of the second section of the second hardway fins;

wherein:

each of the first hardway fins configured to provide the backpressure for maintenance of the fluid level in the tank by having holes in a body of the first hardway fin, the holes of the first hardway fins having a first hole pitch and a second hole pitch that define spacing between immediately adjacent holes of the first hardway fins, each of the holes of the first hardway fins having a hole diameter, the first section of first hardway fins also having a first fin frequency; and each of the second hardway fins configured to provide the backpressure for maintenance of the fluid level of the first fluid in the tank and facilitate fluid distribution for distributing the first fluid on easyway fins by having holes in a body of the second hardway fin, the holes of the second hardway fins having a first hole pitch and a second hole pitch that define spacing between immediately adjacent holes of the second hardway fins, each of the holes of the second hardway fins having a hole diameter, the second section of second hardway fins also having a second fin frequency, the second fin frequency being different than the first fin frequency.

15. The hardway fin arrangement of claim 14, wherein:

the first hole pitch of the first hardway fins is a distance about which immediately adjacent holes are spaced apart in a width direction so that immediately adjacent holes in a row of holes are each spaced apart by a first distance for the first hardway fins;

the first hole pitch of the second hardway fins is a distance about which immediately adjacent holes are spaced apart in a width direction so that immediately adjacent holes in a row of holes are each spaced apart by a second distance for the second hardway fins;

the second hole pitch of the first hardway fins is a distance about which immediately adjacent holes are spaced apart in a length direction so that immediately adjacent holes in a column of holes are each spaced apart by a third distance for the first hardway fins; and the second hole pitch of the second hardway fins is a distance about which immediately adjacent holes are spaced apart in a length direction so that immediately adjacent holes in a column of holes are each spaced apart by a fourth distance for the second hardway fins.

16. The hardway fin arrangement of claim 15, wherein:

the hole diameter of the holes of the first hardway fins differs from the hole diameter of the holes of the second hardway fins.

17. The hardway fin arrangement of claim 16, wherein:

the first hole pitch of the holes of the first hardway fins differ from the first hole pitch of the holes of the second hardway fins; and/or the second hole pitch of the holes of the first hardway fins differ from the second hole pitch of the holes of the second hardway fins.

18. The hardway fin arrangement of claim 15, wherein:

the first hole pitch of the holes of the first hardway fins is a maximum of 50 mm and the first hole pitch of the second hardway fins is a maximum of 10 mm; and the second hole pitch of the holes of the first hardway fins is 0.1-0.95 of a fin height of the first hardway fins and the second hole pitch of the second hardway fins is 0.1-0.95 of a fin height of the second hardway fins.

* * * * *